US011635038B1

(12) United States Patent
Son et al.

(10) Patent No.: US 11,635,038 B1
(45) Date of Patent: Apr. 25, 2023

(54) METHOD OF IMPROVING ACCURACY OF PURGE FUEL AMOUNT AND ACTIVE PURGE SYSTEM THEREFOR

(71) Applicants: Hyundai Motor Company, Seoul (KR); Kia Corporation, Seoul (KR)

(72) Inventors: Jung-Seop Son, Seoul (KR); Tae-Gon Noh, Seoul (KR); Hyung-Seok Yoon, Hwaseong-si (KR)

(73) Assignees: Hyundai Motor Company, Seoul (KR); Kia Corporation, Seoul (KR)

( * ) Notice: Subject to any disclaimer, the term of this patent is extended or adjusted under 35 U.S.C. 154(b) by 0 days.

(21) Appl. No.: 17/899,332

(22) Filed: Aug. 30, 2022

(30) Foreign Application Priority Data

Mar. 22, 2022 (KR) ..... 10-2022-0035401

(51) Int. Cl.
*F02D 41/24* (2006.01)
*F02D 41/00* (2006.01)

(52) U.S. Cl.
CPC ..... *F02D 41/2454* (2013.01); *F02D 41/004* (2013.01); *F02D 41/0035* (2013.01); *F02D 41/2438* (2013.01); *F02D 2200/0406* (2013.01); *F02D 2200/501* (2013.01); *F02D 2200/70* (2013.01)

(58) Field of Classification Search
CPC ..... F02D 41/2454; F02D 41/0035; F02D 41/004; F02D 41/2438; F02D 2200/0406; F02D 2200/501; F02D 2200/70
See application file for complete search history.

(56) References Cited

U.S. PATENT DOCUMENTS

| | | | | |
|---|---|---|---|---|
| 10,527,008 | B2 * | 1/2020 | Kim | F02M 25/0836 |
| 10,563,622 | B2 | 2/2020 | Asanuma et al. | |
| 10,704,500 | B2 | 7/2020 | Asanuma et al. | |
| 10,907,556 | B2 | 2/2021 | Kato et al. | |
| 2003/0221681 | A1 * | 12/2003 | Bidner | F02D 41/2448 123/520 |
| 2017/0159588 | A1 | 6/2017 | Honjo | |
| 2019/0186393 | A1 | 6/2019 | Oh et al. | |
| 2020/0149482 | A1 * | 5/2020 | Dudar | F02M 25/0836 |
| 2020/0149483 | A1 * | 5/2020 | Dudar | F02M 25/0836 |
| 2020/0191072 | A1 | 6/2020 | Ahn | |
| 2020/0191085 | A1 | 6/2020 | Oh | |

FOREIGN PATENT DOCUMENTS

| | | | |
|---|---|---|---|
| JP | 2017180314 | A | 10/2017 |
| JP | 2017180320 | A | 10/2017 |
| JP | 2018044544 | A | 3/2018 |
| JP | 2018155135 | A | 10/2018 |
| KR | 20170066011 | A | 6/2017 |

* cited by examiner

*Primary Examiner* — Joseph J Dallo
(74) *Attorney, Agent, or Firm* — Slater Matsil, LLP

(57) ABSTRACT

An embodiment is a method including controlling a purge fuel amount of an active purge system (APS), the controlling including correcting the purge fuel amount using a primary weighting factor obtained using an ambient air temperature and a hydrocarbon (HC) concentration in purge gas fuel as input values, and correcting the corrected purge fuel amount using a secondary weighting factor due to a purge learning value. Some embodiments further include controlling of the purge fuel amount applies a purge execution condition, and the purge execution condition on the basis of a negative pressure of an intake manifold and a vehicle speed of the vehicle in which a purge flow rate exhibits as being greater than or equal to a predetermined value.

18 Claims, 5 Drawing Sheets

FIG. 2A
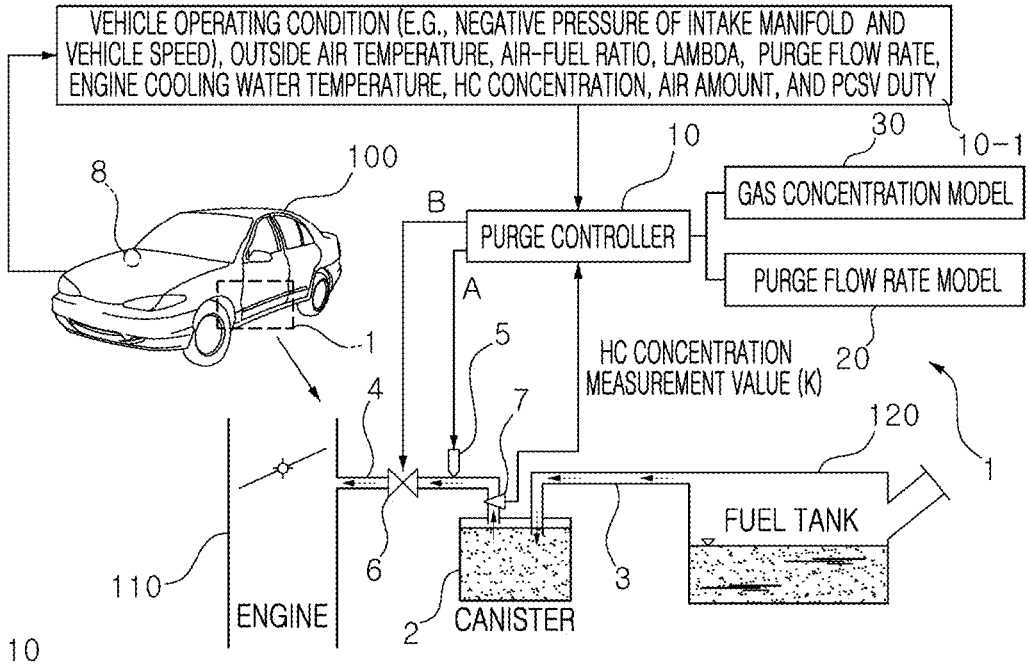
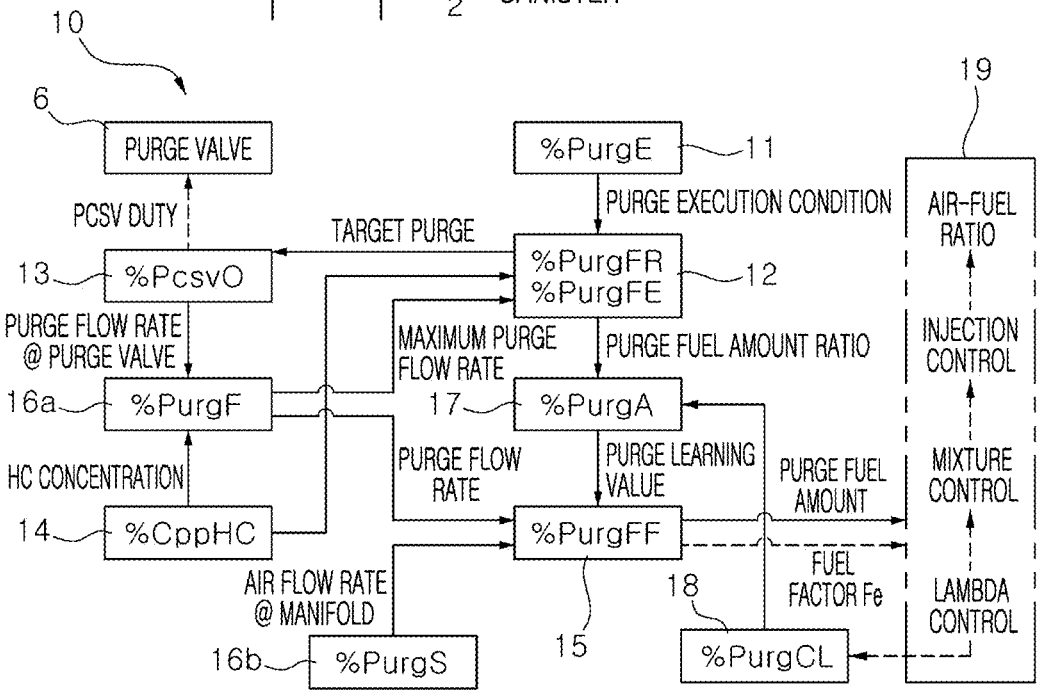
<CONFIGURATION OF PURGE CONTROLLER>
FIG. 2B

METHOD OF IMPROVING ACCURACY OF PURGE FUEL AMOUNT AND ACTIVE PURGE SYSTEM THEREFOR

CROSS-REFERENCE TO RELATED APPLICATIONS

This application claims the benefit of Korean Patent Application No. 10-2022-0035401, filed on Mar. 22, 2022, which application is hereby incorporated herein by reference.

TECHNICAL FIELD

Exemplary embodiments of the present disclosure relate to purge control of a vehicle.

BACKGROUND

Generally, since a fuel evaporative gas including hydrocarbon (HC), which is a pollutant when being discharged to the atmosphere, is generated in a fuel tank of the vehicle, fuel tank evaporative gas purge systems are applied so as to satisfy environmental regulations. In this case, an active purge system (APS) is applied to a hybrid electric vehicle (HEV) or a plug-in hybrid electric vehicle (PHEV) among vehicles.

In particular, the APS employs a canister for collecting a fuel evaporative gas generated from the fuel tank, and an active purge pump (APP) and a purge control solenoid valve (PCSV) which form a pipe line, and transfers a purge flow rate of a predetermined value or more towards an intake manifold according to an operating state (that is, a negative pressure of the intake manifold and a vehicle speed) of a vehicle under the control of a purge controller, thereby preventing the fuel evaporative gas containing HC from being discharged to the atmosphere.

To this end, purge control of a purge fuel amount method uses a gas concentration model reflecting a value of an external concentration sensor installed ambient the canister and a purge flow rate model reflecting the negative pressure of the intake manifold and the vehicle speed and applies a purge fuel amount, which is calculated using a model concentration value on the basis of a HC concentration in the fuel evaporative gas measured by the external concentration sensor, to the purge control, thereby implementing a relatively stable tendency in terms of an air-fuel ratio behavior which may occur after purge is performed.

However, in the purge control of a purge fuel amount method, since accuracy of the model concentration value of the gas concentration model on the basis of the value of the external concentration sensor is less than accuracy of the actual concentration result value, after the purge is performed, a purge learning value reflected in a calculation of the purge fuel amount may be excessively increased, and when the purge learning value is excessively increased, it becomes difficult to limit a purge flow rate.

In particular, in the purge control of a purge fuel amount method, starting, engine warm-up, and a pilot fuel amount, which are air-fuel ratio variation conditions in addition to a purge condition, are not excluded, and a gas concentration of the canister and an external condition such as an external temperature, which are capable of realizing an HC concentration model in the purge gas, cannot be reflected. Due to the air-fuel ratio variation condition and the external condition, it is difficult to solve problems such as an unstable air-fuel ratio behavior and limiting of a purge rate after the purge is performed.

Therefore, the purge control of a purge fuel amount method has a very high probability of occurrence of an error in terms of control, and thus it is inevitably insufficient to respond to regulations regulating HC in fuel evaporative gas.

SUMMARY

An embodiment of the present disclosure is directed to a method of improving accuracy of a purge fuel amount, which performs correcting of a purge fuel amount by reflecting a hydrocarbon (HC) concentration and a learning value on the basis of an ambient air temperature, thereby solving limitation of an inaccurate model concentration value on the basis of an external concentration sensor, and particularly, reflects a change of an air-fuel ratio control value to an update of a purge learning value after purge is performed to satisfy securing of air-fuel ratio stability and a purge rate, and an active purge system therefor.

Other objects and advantages of the present disclosure can be understood by the following description and become apparent with reference to the embodiments of the present disclosure. Also, it is obvious to those skilled in the art to which the present disclosure pertains that the objects and advantages of the present disclosure can be realized by the means as claimed and combinations thereof.

In accordance with an embodiment of the present disclosure, there is provided a method of improving accuracy of a purge fuel amount, which controls a purge gas fuel amount of an active purge system (APS), the method including correcting the purge fuel amount using a primary weighting factor obtained using an ambient air temperature and a hydrocarbon (HC) concentration in purge gas fuel as input values, and correcting the corrected purge fuel amount using a secondary weighting factor due to a purge learning value.

In addition, the method of improving accuracy of a purge fuel amount may include checking, by a purge controller, a purge execution condition of the APS, an external influence reflected purge fuel amount control operation of checking an ambient air temperature condition which changes a concentration of a fuel evaporative gas and calculating a purge fuel amount using a primary weighting factor of a concentration value weighting factor in which a change in a concentration model value of a gas concentration model is compensated for and a secondary weighting factor of a purge learning value according to a change of an air-fuel ratio due to purge, and after the purge control is performed using the purge fuel amount, an external influence reflected purge learning control operation of confirming an air-fuel ratio control value change condition and performing purge learning on the basis of a variable air-fuel ratio.

As an exemplary embodiment, the purge execution condition may be on the basis of a negative pressure of an intake manifold of a vehicle and a vehicle speed in which the purge flow rate is greater than or equal to a predetermined value.

As an exemplary embodiment, the controlling of the purge fuel amount to which an external influence is reflected may include calculating a basic purge fuel amount using a purge flow rate model, confirming a purge fuel amount pre-correction condition using TRUE and FALSE of a CODEWORD #1 BIT SET in the ambient air temperature condition, in TRUE of the CODEWORD #1 BIT SET, calculating the concentration value weighting factor as the primary weighting factor with respect to purge learning due to the purge fuel amount of the purge flow rate model and an ambient air temperature reflected coefficient in which a concentration model value of a gas concentration model is compensated for by the ambient air temperature, confirming a purge fuel amount post-correction condition using TRUE and FALSE of a CODEWORD #2 BIT SET in an air-fuel ratio change condition, calculating a secondary weighting factor with respect to the purge learning value in TRUE of the CODEWORD #2 BIT SET, and setting the primary weighting factor of the concentration value weighting factor and the secondary weighting factor of the purge learning value as a purge fuel amount control coefficient and compensating for the basic purge fuel amount using the purge fuel amount control coefficient to be calculated as the purge fuel amount.

As an exemplary embodiment, the operation of the external influence reflected purge learning control may include applying a vehicle operating condition to the purge learning condition, confirming TRUE and FALSE of a CODEWORD #0 BIT SET, in TRUE of the CODEWORD #0 BIT SET, confirming the air-fuel ratio control value change condition as a purge learning factor, generating a new purge learning signal using a state value of the purge learning factor, and applying the new purge learning to perform the purge learning.

As an exemplary embodiment, the purge learning condition may be applied when the purge flow rate value of the purge flow rate model is greater than or equal to the purge flow rate value on the basis of the vehicle operating condition, and the vehicle operating condition may apply a negative pressure of an intake manifold and a vehicle speed of the vehicle.

As an exemplary embodiment, the purge learning factor may include one or more among a purge control solenoid valve (PCSV) duty, an engine warm-up, and a target air-fuel, and a case in which the PCSV duty is greater than or equal to a predetermined value, the engine warm-up is in a warm-up state, and the target air-fuel ratio is not one may be applied as the purge learning factor.

As an exemplary embodiment, when the air-fuel ratio control value change condition is not confirmed together with the ambient air temperature condition during the controlling of the purge fuel amount, a purge fuel amount may be calculated, wherein the purge fuel amount is obtained by compensating for the basic purge fuel amount using the primary weighting factor of the purge learning value due to the purge fuel amount of the purge flow rate model.

As an exemplary embodiment, when the air-fuel ratio control value change condition is not confirmed, purge learning on the basis of the vehicle operating state may be performed.

In accordance with another embodiment of the present disclosure, there is provided an active purge system (APS) including a purge control solenoid valve (PCSV) configured to open and close a gas discharge line which connects a canister collecting a fuel evaporative gas of a fuel tank to an intake manifold, and a purge controller configured to perform, when purge in which the PCSV is opened is executed, purge control using a purge fuel amount in which a basic purge fuel amount of a purge flow rate model using a primary weighting factor of a concentration value weighting factor by applying an ambient air temperature detected by a temperature sensor provided in a vehicle to a concentration model value of the gas concentration model and a secondary weighting factor of a purge learning value to which an air-fuel ratio change due to the corrected purge is applied, and configured to perform purge learning according to a variable air-fuel ratio in an air-fuel ratio control value change condition which is identified using one or more of a PCSV duty, an engine warm-up, and a target air-fuel ratio.

As an exemplary embodiment, the purge controller may be equipped with a purge concentration provider configured to compensate for the concentration model value of the gas concentration model using a hydrocarbon (HC) concentration on the basis of the ambient air temperature, and data on the HC concentration may be reflected to a target purge of a target purge calculator, a purge fuel amount of a purge fuel amount calculator, and a maximum purge flow rate and a purge flow rate of a purge flow rate provider.

BRIEF DESCRIPTION OF THE DRAWINGS

FIG. 2A is a block diagram illustrating an active purge system of a vehicle according to the present disclosure.

FIG. 2B is a block diagram illustrating a configuration of a purge controller according to the present disclosure.

DETAILED DESCRIPTION OF ILLUSTRATIVE EMBODIMENTS

Exemplary embodiments of the present disclosure will be described below in more detail with reference to the accompanying drawings, and these embodiments are examples of the present disclosure and may be embodied in various other different forms by those skilled in the art to which the present disclosure pertains so that the present disclosure is not limited to these embodiments.

Embodiments of the present disclosure include purge control of a vehicle including an active purge system capable of improving accuracy of a purge fuel amount and calculating a purge fuel amount with accuracy that is consistent between a model concentration value and an actual concentration result value by reflecting an ambient air temperature in a gas concentration model.

Figure 1:
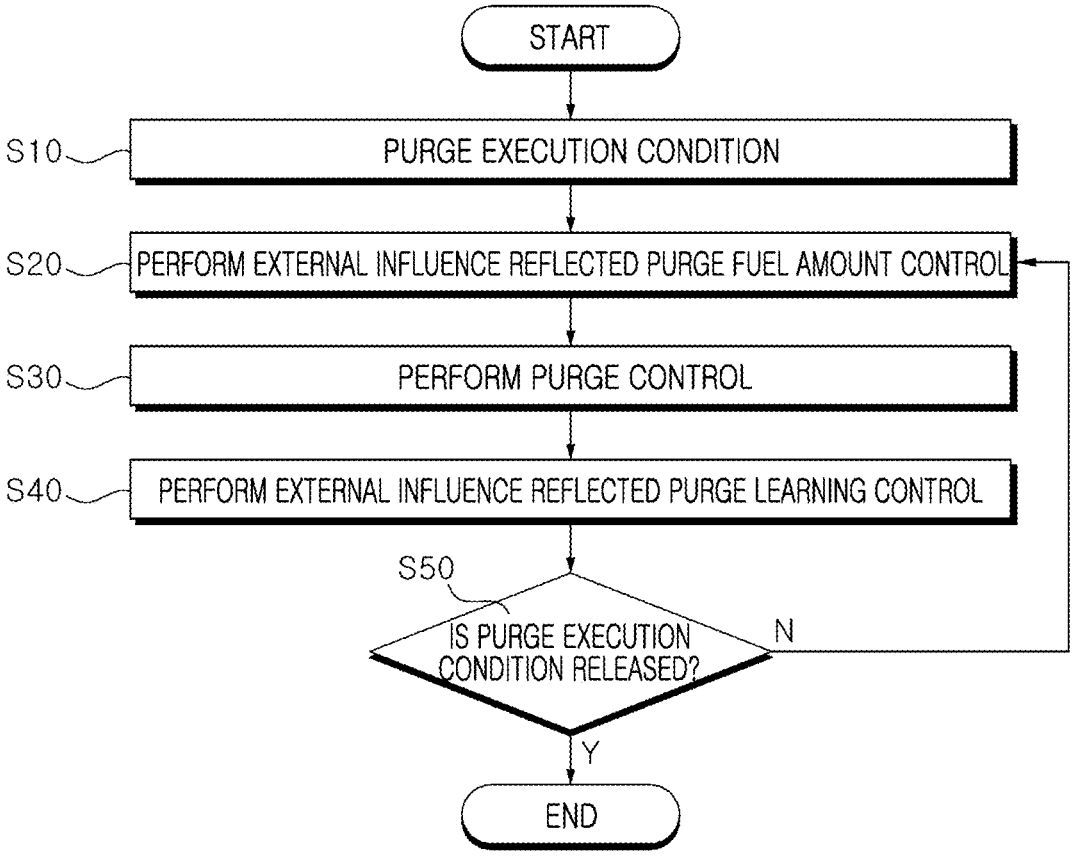
FIG. 1 is a flowchart illustrating a method of improving accuracy of a purge fuel amount according to the present disclosure.

Referring to FIG. 1, a purge control method includes correcting a purge fuel amount with a hydrocarbon (HC) concentration and a purge learning value on the basis of an ambient air temperature through external influence reflected purge fuel amount control (S20) between purge execution condition control (S10) and purge execution condition release control (S50), performing purge control of setting the corrected purge fuel amount as a purge fuel amount (S30), and then performing purge learning to which an air-fuel ratio control value change factor is reflected through external influence reflected purge learning control (S40).

For example, the purge execution condition control (S10) uses a purge flow rate of a predetermined value or more according to a negative pressure of an intake manifold and a vehicle speed of input data 10-1 (see FIGS. 2A and 2B) by which an operating state of a vehicle is known. In this case, the purge flow rate of a predetermined value or more is the same as a purge control condition of an active purge system (APS) applied to internal combustion engine vehicles, particularly, a hybrid electric vehicle (HEV) and a plug-in hybrid electric vehicle (PHEV).

For example, the external influence reflected purge fuel amount control (S20) calculates a weighting factor with respect to the purge fuel amount through an HC concentration applied pre-correction on the basis of the ambient air temperature and a purge learning value applied post-correction, wherein the weighting factor is calculated by correcting a model concentration value of a gas concentration model using the ambient air temperature, so that it is possible to improve accuracy of the purge fuel amount that closely matches the actual concentration result value.

As an example, the external influence reflected purge learning control (S40) applies a purge control solenoid valve (PCSV) duty of a purge valve, whether an engine warms up, and a target air-fuel ratio 1 as a variable factor of an air-fuel ratio control value applied to the purge learning so that it is possible to change a condition of the purge learning value.

Therefore, in the purge control method, the purge gas concentration model with improved accuracy when compared with the existing model may be used for a purge fuel amount calculation, target purge flow rate control, a purge flow rate model calculation, and a PCSV opening speed by reflecting the ambient air temperature. In this way, the HC concentration model is realized in the active purge system of the HEV/PHEV among the vehicles and is actively used for the purge control so that the purge control method is characterized as a method of improving accuracy of the purge fuel amount by correcting the purge fuel amount that simultaneously satisfies stability of the air-fuel ratio and securing of the purge rate.

Referring to FIGS. 2A and 2B, an APS 1 connects an intake manifold 110 of a vehicle 100 to a fuel tank 120 thereof and transfers a fuel evaporative gas of the fuel tank 120 to the intake manifold 110 to combust the fuel evaporative gas. In this case, the vehicle 100 includes an internal combustion engine vehicle, an HEV, and a PHEV.

Specifically, the APS 1 includes, as basic hardware components, a canister 2 connected to the fuel tank 120 through a gas inlet line 3 and configured to collect a fuel evaporative gas and transfer the fuel evaporative gas to the intake manifold 110 through a gas discharge line 4, an active purge pump (APP) 5 configured to rotate to discharge the fuel evaporative gas from the canister 2, a PCSV 6 configured to be opened and closed to form a flow path of the fuel evaporative gas, and a concentration sensor 7 configured to detect an HC concentration value in the fuel evaporative gas and includes a temperature sensor 8, a purge controller 10, a purge flow rate model 20, and a gas concentration model 30.

As an example, the APP 5, the PCSV 6, and the concentration sensor 7 are general components installed on the gas discharge line 4. However, there is a difference in that, since the number of rotations of the APP 5 due to a pump output A of the purge controller 10 and an opening speed of the PCSV 6 due to a PCSV duty output B are controlled, an HC concentration measurement value K of the concentration sensor 7 is transmitted to the purge controller 10 and applied to the gas concentration model 30.

As an example, the temperature sensor 8 is installed in the vehicle 100 and detects an ambient temperature around the vehicle as the ambient air temperature, and the ambient temperature is transmitted to the purge controller 10.

As an example, the purge controller 10 reads the input data 10-1 for control conditions for the APP 5 and the PCSV 6 and reads model values of the purge flow rate model 20 and the gas concentration model 30 for purge control. In this case, the input data 10-1 receives a vehicle operating condition, a negative pressure of the intake manifold by which an air temperature and a degree of a purge flow rate are known, a vehicle speed, an ambient air temperature, an air-fuel ratio, a lambda, the purge flow rate, an engine cooling water temperature, an HC concentration, an air amount, and a PCSV duty, which are detected from the vehicle 100 and the APS 1, and various sensors for the above detection are provided in the vehicle as default built-in sensors.

Therefore, the purge controller 10 is equipped with a memory, in which a program or logic for performing the purge entry/release condition control (S10 and S50), the external influence reflected purge fuel amount control (S20), the purge control (S30), and the external influence reflected purge learning control (S40) are stored, and acts as a central processing unit performing mutual communication through a controller area network (CAN). In this case, the CAN communication includes a bit set of TRUE and FALSE.

As an example, the purge flow rate model 20 constructs a purge flow rate value on the basis of the negative pressure of the intake manifold through which an operating state of the vehicle is known ≒ and the vehicle speed as a table map and provides a purge flow rate required for the purge control to the purge controller 10, and the gas concentration model 30 constructs a model concentration value on the basis of the HC concentration measurement value K of the concentration sensor 7 as a table map and provides a model concentration value corrected by the ambient air temperature of the temperature sensor 8 to the purge controller 10.

Specifically, the purge controller 10 includes a purge condition confirmation part 11, a target purge calculator 12, a target purge provider 13, a purge concentration provider 14, a purge fuel amount calculator 15, a purge flow rate provider 16*a*, an air flow rate provider 16*b*, a purge learning value provider 17, a purge learning calculator 18, and a purge information provider 19 and performs the purge control of a purge fuel amount correction method through an interaction between the above components. In this case, a data exchange is performed through the CAN.

Thus, the components of the purge controller 10 may be divided into providing blocks 11, 13, 14, 16*a*, 16*b*, and 17 and calculation blocks 12, 15, and 18. In this case, each of the calculation blocks 12, 15, and 18 is specifically exemplified by the generated processing result, but the generated processing result is not limited to unique functions of the calculation blocks 12, 15, and 18 and may be complementary to produce processed results.

As an example, the purge condition confirmation part 11 provides the negative pressure of the intake manifold and the vehicle speed, which are the purge execution conditions, of the input data 10-1 to the target purge calculator 12, the target purge provider 13 provides a target purge of the target purge calculator 12 to the purge flow rate provider 16*a*, and the purge concentration provider 14 provides a model concentration value, to which the ambient air temperature is reflected, to the target purge calculator 12, the purge fuel amount calculator 15, and the purge flow rate provider 16*a* as the HC concentration.

In addition, the purge flow rate provider 16*a* provides a maximum purge flow rate to the target purge calculator 12 and provides the purge flow rate to the purge fuel amount calculator 15, the air flow rate provider 16*b* provides an air flow rate to the purge fuel amount calculator 15, the purge learning value provider 17 provides a purge learning value, to which a purge fuel amount ratio of the target purge calculator 12 and a purge learning condition of the purge learning calculator 18 are reflected, to the purge fuel amount calculator 15, and the purge information provider 19 secures a purge performance result according to the purge fuel amount of the purge fuel amount calculator 15. In this case, the purge information provider 19 includes information such as mixture control, an injection calculation, lambda control, and an air-fuel ratio.

As an example, the target purge calculator 12 calculates a target purge flow rate using a concentration purge flow rate on the basis of the model concentration value, to which the ambient air temperature of the purge concentration provider 14 is applied, and the maximum purge flow rate of the purge flow rate provider 16*a* in a purge execution condition, the purge fuel amount calculator 15 calculates a purge fuel amount to which the model concentration value, to which the ambient air temperature of the purge concentration provider 14 is reflected, the purge flow rate of the purge flow rate provider 16*a*, and a purge fuel amount coefficient Fe (see FIG. 3) applied as the air flow rate provider 16*b* are applied, and the purge learning calculator 18 determines and outputs a purge learning condition on the basis of the vehicle driving state or a purge learning condition on the basis of an air-fuel ratio change factor by applying an air-fuel ratio change condition of the purge performance result of the purge information provider 19.

Therefore, the target purge calculator 12 receives pieces of data from the purge condition confirmation part 11, the purge concentration provider 14, and the purge flow rate provider 16*a* and provides processed results to the target purge provider 13 and the purge learning value provider 17, the target purge provider 13 receives data from the target purge calculator 12 and provides a processed result to the PCSV 6 and the purge flow rate provider 16*a*, and the purge concentration provider 14 provides a processed result to the target purge calculator 12, the purge fuel amount calculator 15, and the purge flow rate provider 16*a*. In this case, the processed result may be data itself or processed data.

In addition, the purge fuel amount calculator 15 receives data from the purge concentration provider 14, the purge flow rate provider 16*a*, the air flow rate provider 16*b*, and the purge learning value provider 17 and provides the purge fuel amount to the purge information provider 19 as a processed result, The purge flow rate provider 16*a* receives data from the target purge provider 13 and the purge concentration provider 14 and provides the processed result to the target purge calculator 12 and the purge fuel amount calculator 15, and the air flow rate provider 16*b* provides data to the purge fuel amount calculator 15. In this case, the processed result may be data itself or processed data.

In addition, the purge learning value provider 17 receives data from the target purge calculator 12 and the purge learning calculator 18 and provides the processed result to the purge fuel amount calculator 15, the purge learning calculator 18 receives data from the purge information provider 19 and provides the data to the purge learning value provider 17 as a processed result, and the purge information provider 19 includes mixture control, an injection calculation, lambda control, and an air-fuel ratio as information and provides a lambda value of the lambda control to the purge learning calculator 18. In this case, the processed result may be data itself or processed data.

In particular, when a purge concentration and an ambient air temperature are high, the purge fuel amount calculator 15 sets the purge fuel amount to be large, whereas, when the purge concentration and the ambient air temperature are low, the purge fuel amount calculator 15 sets the purge fuel amount to be small.

Therefore, the purge control of the purge controller 10 (1) may minimize variability of the air-fuel ratio according to a purge entry under various conditions by pre-reflecting a correction of the purge fuel amount on the basis of the purge gas concentration, (2) may change an update condition of a learning value in a state in which the variability of the air-fuel ratio is not large to reflect only the variability of the air-fuel ratio due to purge as much as possible, (3) may minimize variability of a purge learning value and finally use the purge learning value in correction of a fuel amount only by a variation in air-fuel ratio due to the purge, and (4) since interaction of the purge learning value and the calculation of the purge fuel amount interact, may reflect a fuel amount calculation on the basis of an open loop to the purge fuel amount to prioritize accuracy of correction by the purge gas concentration and the ambient air temperature and then perform the air-fuel ratio control using a closed loop with a purge learning value updated by the variability of the air-fuel ratio control value.

Hereinafter, a method of improving accuracy of the purge fuel amount of FIG. 1 will be described in detail with reference to FIGS. 2A to 5. In this case, a control main body is the purge controller 10, and a control target is the APP 5 and the PCSV 6.

Figure 3:
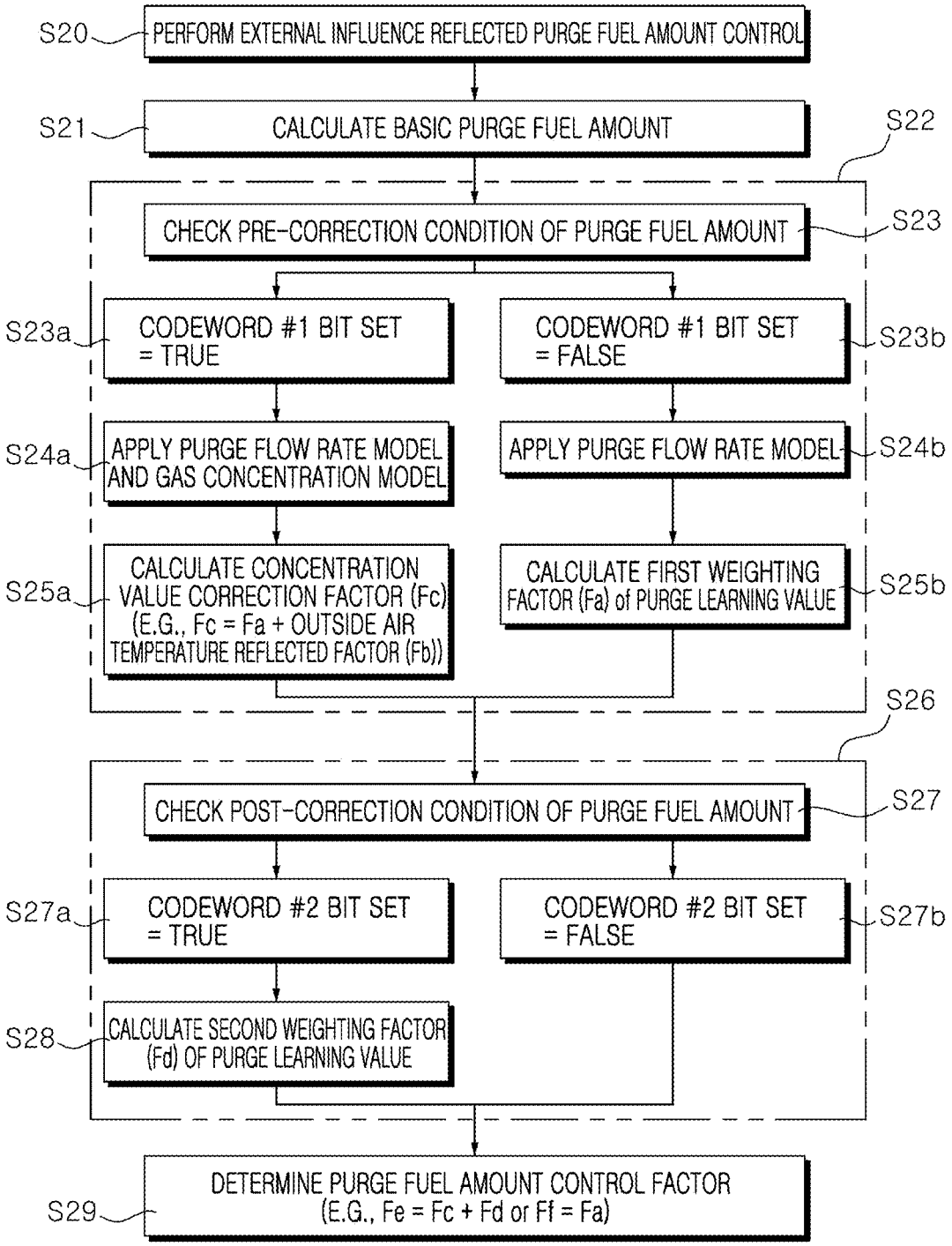
FIG. 3 is a flowchart illustrating a process of improving accuracy of external influence reflected purge fuel amount control on the basis of an ambient air temperature in a purge control method according to the present disclosure.

Referring to FIG. 3, the external influence reflected purge fuel amount control (S20) includes calculating a basic purge fuel amount (S21), pre-correcting the purge fuel amount (S22), post-correcting the purge fuel amount (S26), and determining a purge fuel amount control factor Fd (S29).

Referring to FIGS. 2A and 2B, the purge controller 10 performs the calculating of the basic purge fuel amount (S21) by calculating the basic purge fuel amount on the basis of a theoretical air-fuel ratio in the target purge calculator 12 which receives a purge flow rate from the purge flow rate provider 16*a* among the input data 10-1. In this case, the basic purge fuel amount is on the basis of a fuel amount (i.e., injected fuel) which meets a theoretical air-fuel ratio of a current air amount.

In addition, the purge controller 10 performs the pre-correcting of the purge fuel amount (S22) though checking a pre-correction condition of the purge fuel amount (S23), correcting a concentration-reflected purge fuel amount (S23*a* to S25*a*), and correcting a flow rate reflected purge fuel amount (S23*b* to S25*b*).

For example, the result of checking of the pre-correction condition of the purge fuel amount (S23) can either be a CODEWORD BIT SET to TRUE or a CODEWORD BIT SET to FALSE. When set to TRUE, the correcting of the concentration-reflected purge fuel amount is performed (S23*a* to S25*a*), whereas when set to FALSE, the correcting of the flow rate reflected purge fuel amount is performed (S23*b* to S25*b*).

In particular, setting of TRUE or FALSE of the CODEWORD BIT SET are on the basis of the ambient air temperature value of the temperature sensor which indirectly affects the purge concentration. A CODEWORD BIT SET=TRUE is generated when a purge concentration/ambient air temperature are higher than a reference value, and a CODEWORD BIT SET=FALSE is generated when a purge concentration/ambient air temperature are lower than a reference value. In some embodiments, the reference value may be set through a difference between the HC concentration value of the concentration sensor 7 and an HC concentration value estimated from the outdoor temperature.

For example, the correcting of the concentration-reflected purge fuel amount (S23*a* to S25*a*) is performed through checking BIT SET=TRUE of a CODEWORD #1 (S23*a*) during the checking of the pre-correction condition purge fuel amount (S23), applying a purge flow rate and a gas concentration model (S24*a*), and calculating a concentration value correction factor Fc (S25*a*). In addition, the correcting of the flow rate reflected purge fuel amount (S23*b* to S25*b*) is performed through checking BIT SET=FALSE of the CODEWORD #1 (S23*b*) during the checking of the pre-correction condition purge fuel amount (S23), applying the purge flow rate model (S24*b*), and calculating a primary weighting factor Fa with respect to the purge learning value (S25*b*). In this case, the codeword is a bit set for determining a path of a logic. For example, when a #0 bit of the codeword is a set (True) according to the setting, the logic proceeds to path A, and when the #0 bit of the codeword is a set X (False), the logic proceeds to path B.

Referring to FIGS. 2A and 2B, the purge controller 10 checks a purge flow rate model value of the purge flow rate model 20, the target purge calculator 12 for calculating a target purge provides a purge fuel amount ratio on the basis of a maximum purge flow rate of the purge flow rate provider 16*a*, to which the HC concentration of the purge concentration provider 14 is reflected, to the purge learning value provider 17, the purge fuel amount calculator 15 calculates a purge learning value of the purge learning value provider 17 as a primary weighting factor Fa with respect to the purge learning value, and thus the purge controller 10 performs the correcting of the flow rate reflected purge fuel amount (S23*b* to S25*b*). In this case, the primary weighting factor Fa with respect to the purge learning value is the same as the previously applied purge learning value weighting factor. In this case, the HC concentration and the purge flow rate may be provided as information of the input data 10-1.

In particular, after confirming the model concentration value of the gas concentration model 30, the purge controller 10 generates a predicted concentration model value by calculating the purge flow rate model value to which the purge gas concentration of the concentration sensor 7 and the ambient air temperature of the temperature sensor 8 are reflected in a concentration model correction logic of the purge concentration provider 14 and provides a HC concentration value of the predicted concentration model value to the target purge calculator 12, the purge fuel amount calculator 15, and the purge flow rate provider 16*a*, thereby using the HC concentration value in target purge flow rate control, a calculation of the purge fuel amount, and an opening speed of the PCSV 6.

Therefore, the purge controller 10 calculates an ambient air temperature reflected coefficient Fb by setting the concentration model value of the gas concentration model 30 as the ambient air temperature reflected prediction concentration model value and sums the ambient air temperature reflected coefficient Fb with the primary weighting factor Fa of the purge learning value to calculate a concentration value correction coefficient (Fc=Fa+Fb), thereby completing the correcting of the concentration-reflected purge fuel amount (S23*a* to S25*a*). In this case, the ambient air temperature reflection coefficient Fb is set to a coefficient value having no influence of the primary weighting factor Fa of the purge learning value. To this end, a coefficient value range may be different.

Then, the purge controller 10 performs the post-correcting of the purge fuel amount (S26) through checking a post-correction condition of the purge fuel amount (S27), checking a #2 CODEWORD BIT SET=TRUE (S27*a*) of the post-correction condition of the purge fuel amount (S27), checking the #2 CODEWORD BIT SET=FALSE (S27*b*) of the post-correction condition of the purge fuel amount (S27), and calculating a secondary weighting factor Fd of the purge learning value (S28).

That is, the purge fuel amount is pre-corrected through a control factor (weighting factor) which uses the HC concentration model value in the purge gas and the ambient air temperature as inputs, and then post-correction (Add Term) is performed on the purge learning values so that it may be logically configured such that only an air-fuel ratio deviation due to the purge may be reflected to the purge learning value.

With the above description, the purge controller 10 completes the post-correction of the purge fuel amount (S27 and S28) such that an air-fuel ratio corrector 17*a* of the purge learning value provider 17 provides the air-fuel ratio change of the purge information provider 19 to the purge fuel amount calculator 15, and the purge fuel amount calculator 15 calculates a purge learning value, in which an air-fuel ratio control value standard is reflected to the existing purge learning value confirmed in the previous operation, as the secondary weighting factor Fd.

Finally, the purge controller 10 sets the corrected concentration-based control coefficient (Fe=Fc+Fd), which is the sum of the concentration value correction factor Fc and the secondary weighting factor Fd of the purge learning value, or the primary weighting factor Fa of the purge learning value as a concentration-based control coefficient Ff, thereby completing determining the purge fuel amount control coefficient (S29).

Therefore, the performing of the purge control (S30) may dualize the corrected concentration-based control coefficient (Fe=Fc+Fd) into a purge fuel amount control coefficient and the concentration-based control coefficient Ff into a purge fuel amount control coefficient.

In this way, application of the corrected concentration-based control coefficient (Fe=Fc+Fd) to the purge fuel amount uses the concentration model value of the gas concentration model 30 on the basis of the concentration sensor 7 as a predicted concentration model corrected using the ambient air temperature of the temperature sensor 8 so that the purge learning value is calculated on the basis of the air-fuel ratio deviation of the air-fuel ratio control value due to the purge reflected to the purge learning value, whereas, like the existing purge control method using the concentration model value of the gas concentration model 30 on the basis of the concentration sensor 7, application of the concentration-based control coefficient Ff to the purge fuel amount calculates the purge learning value on the basis of the air-fuel ratio control value.

Figure 4:
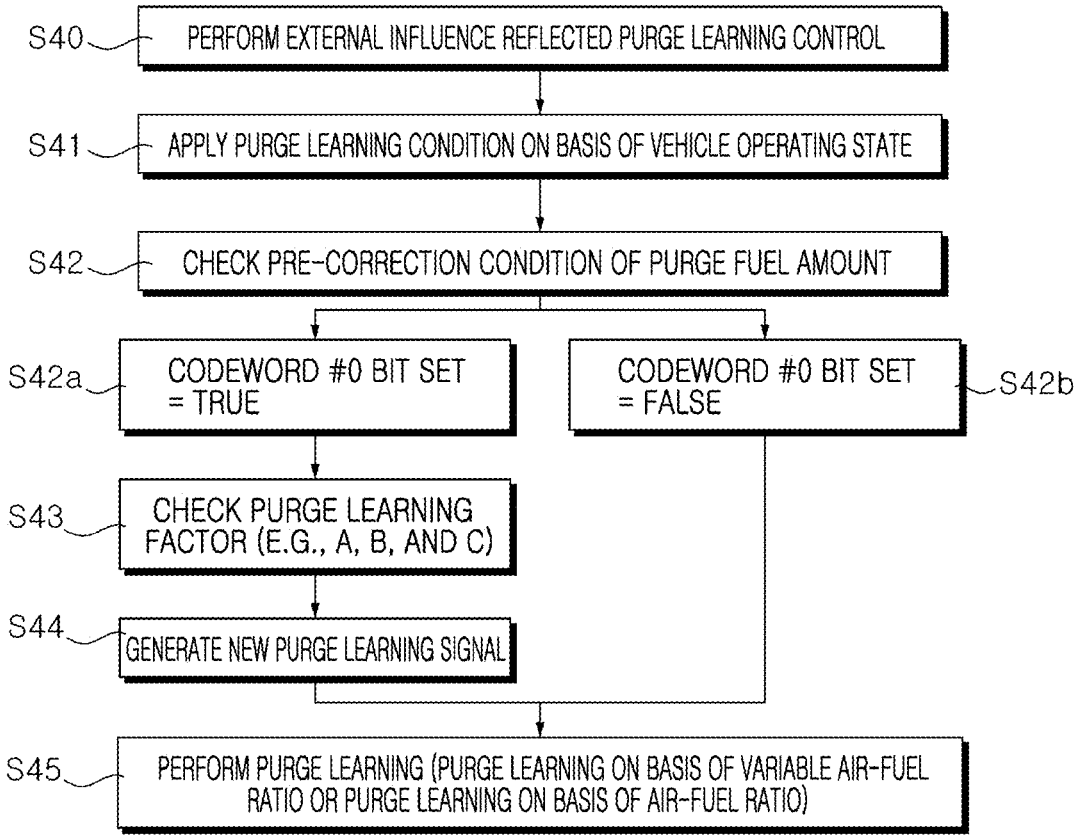
FIG. 4 is a flowchart illustrating a process of improving accuracy of external influence reflected purge learning control on the basis of the ambient air temperature in the purge control method according to the present disclosure.

Meanwhile, referring to FIG. 4, the external influence reflected purge learning control S40 is purge learning condition change control and is performed through applying a purge learning condition on the basis of a vehicle operating state (S41), checking a purge learning condition change (S42), checking a CODEWORD #0 BIT SET=TRUE (S42*a*) of the purge learning condition (S42), checking the CODEWORD #0 BIT SET=FALSE (S42*b*) of the purge learning condition (S42), checking the purge learning factor (S43), generating a new purge learning signal (S44), and performing the purge learning (S45).

Referring to FIGS. 2A and 2B, the purge controller 10 checks the purge flow rate model value of the purge flow rate model 20 in the purge condition confirmation part 11 and the purge flow rate according to the negative pressure of the intake manifold and the vehicle speed, which are the operating condition of the input data 10-1, applies the purge learning condition on the basis of the vehicle operating state (S41) when the purge flow rate model value is greater than or equal to the purge flow rate value, or switches to the purge execution condition release control (S50) when the purge flow rate model value is less than the purge flow rate value. In this case, the purge flow rate is confirmed as a measured value or a logic calculated value of a flow sensor (not shown).

That is, the new purge learning is determined using one or more of the PCSV Duty standard, the presence or absence of an engine warm-up, and a state in which the target air-fuel ratio is not one as the purge learning factor so that the purge learning value is updated according to a change of the air-fuel ratio control value, and thus it may be logically configured such that only the change of the air-fuel ratio control value due to the purge itself is reflected to the purge learning value.

In this way, the purge controller 10 sets a "PCSV Duty A of a predetermined value or more," "an engine warm-up state B," and "a target air-fuel ratio C that is less than one" which are checked using the PCSV Duty, the engine warm-up, the target air-fuel ratio which are the purge learning factors in a purge learning corrector 18*a* of the purge learning calculator 18 as the changes of the air-fuel ratio control values and provides the changes of the air-fuel ratio control values to the purge fuel amount calculator 15 through the purge learning value provider 17, and the purge fuel amount calculator 15 converts the existing purge learning signal checked in the previous operation into a new purge learning signal to which the changes in the air-fuel ratio control values are reflected so that the generating of the new purge learning signal (S44) is completed.

Finally, the purge controller 10 applies purge learning on the basis of a variable air-fuel ratio or purge learning on the basis of an air-fuel ratio to the performing of the purge learning (S45).

Therefore, the performing of the purge learning (S45) may be dualized into the purge learning on the basis of the variable air-fuel ratio or the purge learning on the basis of the air-fuel ratio. In this way, the purge learning on the basis of the variable air-fuel ratio reflects the "PCSV Duty A of a predetermined value or more,", the "engine warm-up state B," and the "target air-fuel ratio C that is less than one" so that only the change in the air-fuel ratio control value due to the purge itself is reflected to the learning value through the updating of the purge learning value according to the change of the air-fuel ratio control value, whereas, as in the related art, the purge learning on the basis of the air-fuel ratio is performed when the purge flow rate is greater than or equal to a predetermined value according to the vehicle operating driving state (i.e., a negative pressure of the intake manifold and a vehicle speed).

Figure 5:
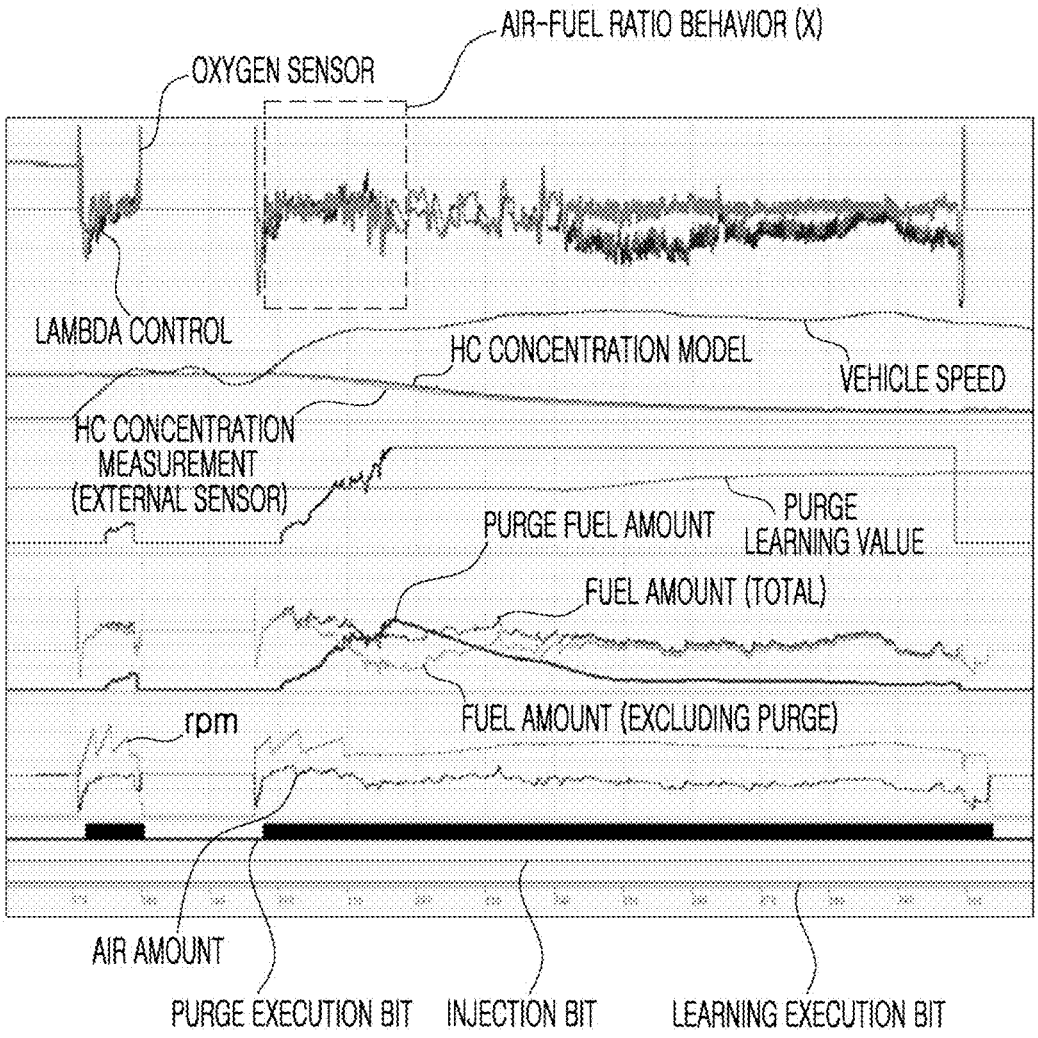
FIG. 5 is a diagram illustrating a result state of securing air-fuel ratio stability and a purge rate of the active purge system through external influence reflected purge control according to the present disclosure.

Meanwhile, referring to FIG. 5, in a maximum condition (i.e., full loading) canister state when the vehicle 100 is traveling on an inclined road, the APS 1 performs the purge control of the purge fuel amount correction method, and as a test result, it can be seen that a non-conspicuous air-fuel ratio behavior X exhibits.

As described above, the purge control method of a purge fuel amount correction method implemented in the active purge system 1 according to the present embodiment performs the purge control using the purge fuel amount obtained by compensating for the basic purge fuel amount of the purge flow rate model 20 using, when the APS 1 enters the purge, the concentration value weighting factor Fc obtained by applying the ambient air temperature of the temperature sensor 8 to the concentration model value of the gas concentration model 30 and using the secondary weighting factor Fd of the purge learning value to which a variation of the air-fuel ratio due to the purge is applied and includes the purge control and the purge learning of the purge controller 10 according to the varied air-fuel ratio in the air-fuel ratio control value variation condition which is confirmed as one or more among the PCSV Duty, the engine warm-up, and the target air-fuel ratio so that accuracy limit of the model concentration value applied only to the external concentration sensor 7 is solved through the HC concentration compensation to which the ambient air temperature with respect to the gas concentration model 30 of the purge concentration provider 14 is also reflected and, particularly, the variation of the air-fuel ratio control value is reflected to the updating of the purge learning value after the purge is performed so that stability of the air-fuel ratio and securing of the purge rate can be satisfied.

Purge control of an active purge system for a vehicle of the present disclosure implements the following actions and effects.

First, by reflecting an ambient air temperature-based hydrocarbon (HC) concentration and a learning value to purge fuel amount control, an accuracy difference between a model concentration value and an actual concentration result value, which greatly affects a purge fuel amount of the purge control, can be solved. Second, since the purge fuel amount corrected on the basis of an actual concentration result value is applied using a gas concentration model to which an external temperature is reflected, the purge fuel amount to which an external influence is reflected before the purge is performed is corrected so that accuracy of the purge fuel amount can be improved. Third, an accurate purge fuel amount is used so that difficulty of limiting the purge flow rate due to an excessive increase in the purge learning value as before can be solved. Fourth, an accurate concentration model value on the basis of the ambient air temperature is applied to a purge fuel amount calculation, target purge flow rate control, a purge flow rate model calculation, and PCSV opening speed control so that, after the purge, stability of an air-fuel ratio and securing of a purge rate can be simultaneously satisfied. Fifth, since the ambient air temperature is reflected to the gas concentration model, it is possible to perform more effective purge control in a hybrid electric vehicle (HEV) and a plug-in hybrid electric vehicle (PHEV), in which the HC concentration of a vehicle can be estimated on the basis of the ambient air temperature.

While the present disclosure has been described with reference to the accompanying drawings, it will be apparent to those skilled in the art that various changes and modifications can be made without departing from the spirit and scope of the present disclosure without being limited to the exemplary embodiments disclosed herein. Accordingly, it should be noted that such alternations or modifications fall within the claims of the present disclosure, and the scope of the present disclosure should be construed on the basis of the appended claims.

What is claimed is:

1. A method comprising:

controlling a purge fuel amount of an active purge system (APS), the controlling comprising:

correcting the purge fuel amount using a primary weighting factor obtained using an ambient air temperature and a hydrocarbon (HC) concentration in purge gas fuel as input values; and correcting the corrected purge fuel amount using a secondary weighting factor due to a purge learning value.

2. The method of claim 1, wherein the controlling of the purge fuel amount applies a purge execution condition, and the purge execution condition is on the basis of a negative pressure of an intake manifold and a vehicle speed of the vehicle in which a purge flow rate exhibits as being greater than or equal to a predetermined value.

3. The method of claim 1, wherein:

the primary weighting factor and the secondary weighting factor are established by external influence reflected purge learning control; and the controlling of the purge fuel amount to which an external influence is reflected includes:

calculating a basic purge fuel amount using a purge flow rate model;

a purge fuel amount pre-correction operation of, in a condition of the ambient air temperature, calculating a concentration value weighting factor in which a change in a concentration model value of a gas concentration model is compensated for as the primary weighting factor with respect to the purge learning value and an ambient air temperature reflected coefficient;

a purge fuel amount post-correction operation of, in an air-fuel ratio change condition, calculating the secondary weighting factor with respect to the purge learning value according to the air-fuel ratio change due to purge; and setting the primary weighting factor and the secondary weighting factor of the concentration value weighting factor as a purge fuel amount control coefficient and compensating for the basic purge fuel amount using the purge fuel amount control coefficient to be calculated as the purge fuel amount.

4. The method of claim 3, wherein the basic purge fuel amount is calculated from the purge flow rate model through a theoretical air-fuel ratio of the amount of air when the purge is executed.

5. The method of claim 3, wherein the purge fuel amount pre-correction operation includes:

confirming TRUE and FALSE of a CODEWORD #1 BIT SET in a condition of the ambient air temperature; and in TRUE of the CODEWORD #1 BIT SET, calculating the concentration value weighting factor as the primary weighting factor due to the purge fuel amount of the purge flow rate model and an ambient air temperature reflection coefficient in which a concentration model value of the gas concentration model is compensated for by the ambient air temperature.

6. The method of claim 3, wherein the purge fuel amount post-correction operation includes:

confirming TRUE and FALSE of a CODEWORD #2 BIT SET in the air-fuel ratio change condition; and calculating the secondary weighting factor in TRUE of the CODEWORD #2 BIT SET.

7. The method of claim 3, wherein:

after the purge control is performed using the purge fuel amount, the external influence reflected purge learning control is performed; and the operation of the external influence reflected purge learning control includes:

applying a vehicle operating condition to the purge learning condition;

confirming TRUE and FALSE of a CODEWORD #0 BIT SET;

in TRUE of the CODEWORD #0 BIT SET, after the purge control is performed using the purge fuel amount, confirming the air-fuel ratio control value change condition as a purge learning factor;

generating a new purge learning signal using a state value of the purge learning factor; and applying the new purge learning to perform the purge learning.

8. The method of claim 7, wherein the purge learning condition is applied when the purge flow rate value of the purge flow rate model is greater than or equal to the purge flow rate value on the basis of the vehicle operating condition.

9. The method of claim 8, wherein the vehicle operating condition applies a negative pressure of an intake manifold and a vehicle speed of the vehicle.

10. The method of claim 7, wherein the purge learning factor includes one or more among a purge control solenoid valve (PCSV) duty, an engine warm-up, and a target air-fuel ratio.

11. The method of claim 10, wherein a case in which the PCSV duty is greater than or equal to a predetermined value, the engine warm-up is in a warm-up state, and the target air-fuel ratio is not one is applied as the purge learning factor.

12. The method of claim 7, wherein, when the air-fuel ratio control value change condition is not confirmed during the controlling of the purge fuel amount, purge learning on the basis of the vehicle operating state is performed.

13. The method of claim 3, wherein, when the air-fuel ratio control value change condition is not confirmed together with the ambient air temperature condition during the controlling of the purge fuel amount, calculating a purge fuel amount obtained by compensating for the basic purge fuel amount using the primary weighting factor of the purge learning value due to the purge fuel amount of the purge flow rate model.

14. An active purge system, comprising:

a purge control solenoid valve (PCSV) configured to open and close a gas discharge line which connects a canister collecting a fuel evaporative gas of a fuel tank to an intake manifold; and a purge controller configured to:

perform, when purge is executed in which the PCSV is opened, purge control using a purge fuel amount in which a basic purge fuel amount of a purge flow rate model using a primary weighting factor of a concentration value weighting factor by applying an ambient air temperature detected by a temperature sensor provided in a vehicle to a concentration model value of the gas concentration model and a secondary weighting factor of a purge learning value to which an air-fuel ratio change due to purge is applied, and perform purge learning according to a variable air-fuel ratio in an air-fuel ratio control value change condition which is identified using one or more of a PCSV duty, an engine warm-up, and a target air-fuel ratio.

15. The active purge system of claim 14, wherein the ambient air temperature is detected by a temperature sensor provided in a vehicle.

16. The active purge system of claim 14, wherein:

the purge controller is equipped with a purge concentration provider configured to compensate for the concentration model value of the gas concentration model using a hydrocarbon (HC) concentration on the basis of the ambient air temperature; and data on the HC concentration is reflected to a target purge of a target purge calculator, a purge fuel amount of a purge fuel amount calculator, and a maximum purge flow rate and a purge flow rate of a purge flow rate provider.

17. A method of controlling a purge fuel amount of an active purge system (APS), the method comprising:

calculating a basic purge fuel amount using a purge flow rate model;

calculating a concentration value weighting factor in which a change in a concentration model value of a gas concentration model is compensated for as the primary weighting factor with respect to a purge learning value and an ambient air temperature reflected coefficient;

calculating a secondary weighting factor with respect to the purge learning value according to the air-fuel ratio change due to purge;

setting the primary weighting factor and the secondary weighting factor of the concentration value weighting factor as a purge fuel amount control coefficient; and compensating for the basic purge fuel amount using the purge fuel amount control coefficient.

18. The method of claim 17, wherein the controlling of the purge fuel amount applies a purge execution condition, and the purge execution condition is on the basis of a negative pressure of an intake manifold and a vehicle speed of the vehicle in which a purge flow rate exhibits as being greater than or equal to a predetermined value.

* * * * *